United States Patent [19]

Petkovic-Luton

[11] 4,437,900

[45] Mar. 20, 1984

[54] THERMAL MECHANICAL TREATMENT FOR ENHANCING HIGH TEMPERATURE PROPERTIES OF CAST AUSTENITIC STEEL STRUCTURES

[75] Inventor: Ruzica Petkovic-Luton, Englewood, N.J.

[73] Assignee: Exxon Research and Engineering Co., Florham Park, N.J.

[21] Appl. No.: 455,881

[22] Filed: Jan. 5, 1983

Related U.S. Application Data

[63] Continuation of Ser. No. 334,651, Dec. 28, 1981, abandoned.

[51] Int. Cl.[3] ..... C21D 7/14

[52] U.S. Cl. ..... 148/12 E

[58] Field of Search ..... 148/12 E, 12 R

[56] References Cited

U.S. PATENT DOCUMENTS

| | | | |
|---|---|---|---|
| 2,920,007 | 1/1960 | Buckland | 148/410 |
| 2,931,744 | 4/1960 | Samuels | 148/11.5 R |
| 3,201,288 | 8/1975 | Grange | 148/12.4 |
| 3,755,004 | 8/1973 | Miller | 148/12.4 |
| 4,138,279 | 2/1979 | Murakami et al. | 148/12 E |
| 4,314,861 | 2/1982 | Murakami et al. | 148/12 E |

*Primary Examiner*—W. Stallard

*Attorney, Agent, or Firm*—Henry E. Naylor

[57] ABSTRACT

Disclosed is a thermal mechanical treatment for improving the high temperature properties of cast austenitic heat resistant chromium-containing alloy steel structures which method comprises (a) heating the structures to at least the temperature at which chromium carbides go into solution, but below the temperature where incipient melting occurs; (b) maintaining the structures at such a temperature long enough so that at least 50% of the chromium carbides go into solution; (c) applying from about 15% to 60% plastic deformation by hot forming operations; and (d) cooling the structures to room temperature at such a rate to allow complete recrystallization of the grains to occur.

10 Claims, No Drawings

THERMAL MECHANICAL TREATMENT FOR ENHANCING HIGH TEMPERATURE PROPERTIES OF CAST AUSTENITIC STEEL STRUCTURES

This is a continuation of application Ser. No. 334,651, filed Dec. 28, 1981, and now abandoned.

BACKGROUND OF THE INVENTION

This invention relates to a method of thermal mechanically treating cast austenitic heat resistant alloy structures to produce structures having superior strength and superior ductility at elevated temperatures and which also exhibit improved creep properties when exposed to carburizing or oxidizing environments at high temperatures.

Various industrial processes, especially chemical processes, create an insatiable demand for alloys and alloy products which can withstand higher and higher temperatures and environments deleterious to the alloys. Such deleterious environments include both carburizing and oxidizing environments, both of which are known to significantly affect plant performance and efficiency in many industrial processes. These effects are evidenced in such heat treatment equipment as, ethylene pyrolysis tubing, carbon dioxide and helium cooled nuclear reactors, coal processing plants, hydrocarbon reformers, and steam generators.

A variety of alloys and alloy products have been designed for application in such environments. More particularly, austenitic alloy steels exhibiting heat resistance and carburization resistance have been developed for use in pyrolysis furnaces for the thermal decomposition or organic compounds, such as the steam cracking of hydrocarbons. Generally, the pyrolysis furnace contains a series of heat-resistant alloy steel tubes in which the reaction occurs. The term "tube" as used herein also includes fittings, pipes and other parts used to contain carburizing and oxidizing materials at elevated temperatures.

When casting austenitic alloy steel into structures such as tubes, a microstructure develops which consists primarily of columnar grains oriented radially through the thickness of the tube wall. During high temperature service, this type of grain structure encourages the nucleation and propagation of cracks, which once initiated, have a tendency to run throughout the thickness of the structure. Because of this serious detriment, it is highly desirable to develop a method of treating such structures so as to inhibit the initiation and propagation of such cracks. Furthermore, it would be even more desirable to inhibit the initiation and propagation of such cracks while improving other high temperature properties such as creep and ductility.

SUMMARY OF THE INVENTION

In accordance with the present invention, there is provided a thermal mechanical treatment for improving the high temperature properties of cast austenitic heat-resistant chromium-containing alloy steel structures, which method comprises (a) heating the structures to at least the temperature at which chromium carbides go into solution, but below the temperature where incipient melting occurs; (b) maintaining the structures at such a temperature long enough so that at least 50% of the chromium carbides go into solution; (c) applying from about 15% to 60% plastic deformation by hot forming operations; and (d) cooling the structures to room temperature at such a rate to allow complete recrystallization of the grains to occur.

DETAILED DESCRIPTION OF THE INVENTION

Austenitic alloy structures which can be treated in accordance with the invention are those structures which are fabricated by casting methods and which have been developed for high temperature application. Generally these structures are nickel-based or contain up to about 30 wt.% iron. The structure employed herein will contain from about 20 to about 30 wt.% chromium and about 0.25 to about 0.55 wt.% carbon, preferably about 0.3 to 0.5 wt.% carbon. The structure may also contain minor amounts of such elements as silicon, tungsten, molybdenum, manganese, niobium, hafnium, aluminum, yttrium, etc. as well as both tramp elements and minor amounts of impurities typically found in such alloys.

By treating the structures in accordance with the present invention, the as-cast microstructure is modified such that a relatively coarse equiaxed grain structure is developed thereby minimizing the number of grain boundaries which are oriented transversely to the principal stress. By relatively coarse equiaxed grains, we mean equiaxed grains having a grain size of about ASTM 6 to 2 that is about 45 μm to about 180 μm. Very fine grains are undesirable because they maximize grain boundary sliding during creep, thereby lowering the strength of the alloy and contributing to the nucleation and propagation of cracks.

After thermal mechanical treatment according to the invention, structures are obtained having:

(a) superior high temperature strength;
(b) superior high temperature ductility;
(c) improved creep properties at high temperatures;
(d) increased grain boundary area, thereby decreasing the volume fraction of continuous carbides and minimizing the sites of crack nucleation;
(e) grain boundaries of the required orientation which will minimize crack propagation; and
(f) blocky carbides at the grain boundaries which provide grain stability and prevent grain growth during re-exposure to high temperatures.

In treating the structures in accordance with the present invention, the structures are heated to a temperature at which the chromium carbides go into solution, but below the temperature where incipient melting occurs. The term incipient melting as used herein means those temperatures at which the lower melting phases of the alloys employed begin to melt. Generally, the structures are heated to a temperature of about 1050° C. to 1300° C., preferably about 1100° to 1200° C. The structures are maintained at that temperature for an effective amount of time. By effective amount of time we mean that amount of time required to allow at least 50% of the chromium carbides to go into solution. While still maintaining the structures at such high temperatures, controlled plastic deformation is applied to the structures by hot forming operations so that about 15% to 60% deformation occurs, preferably the deformation is applied in stages of about 10 to 15% per stage. Non-limiting examples of hot forming operations suitable for use in the instant invention include rolling, extrusion, drawing and forging. In general, any hot forming operation is suitable which will cause deformation at the temperatures where chromium carbides go into solution. Below those temperatures the compatability stress in the vicinity of the carbide particles are not relaxed by creep in the matrix, instead cracks are generated as an alternative relaxation mechanism.

On completion of deformation, the structures are transferred to a furnace and cooled at a rate not to exceed about 100° C./hr to allow recrystallization of the grains to occur.

A further understanding of the invention can be obtained by reference to the following examples which are presented for purposes of illustrating the present invention and are not intended to be limiting unless otherwise specified.

COMPARATIVE EXAMPLES A–E

Five coupons having the dimensions 1.25 cm×5 cm×20 cm were taken from the wall of a cast austenitic steel tube comprised of about: 0.44 wt% C, 1.35 wt% Si, 0.6 wt% Mn, 25.1 wt% Cr, 21.2 wt% Ni, 0.03 wt% Mo, and the balance being Fe. The original as-cast microstructure of each coupon consisted of a mixture of equiaxed and columnar grains of about 1.5 mm average diameter, which grains are heavily cored with a continuous network of chromium carbides.

Each of the coupons was deformed by about 60% by cold rolling and subsequently annealed in a tubular furnace at a temperature of about 1000° C.±5° C., except coupon E which was subjected to an additional annealing step at 800° C. All annealing was performed in a high purity argon atmosphere. Table I below sets forth the temperatures and times for which each coupon was annealed.

TABLE I

| | 1st Anneal | | 2nd Anneal | |
|---|---|---|---|---|
| Comp. Ex. | Temp. °C. | Time hr | Temp. °C. | Time hr |
| A | 1000 | 1 | | |
| B | 1000 | 8 | | |
| C | 1000 | 24 | | |
| D | 1000 | 120 | | |
| E | 1000 | 24 | 800 | 1 |

All coupons evidenced substantial recrystallization after the annealing treatment and the microstructure of each was found to contain a discontinuous carbide network having recrystallized equiaxed grains of about 10 μm in size. Although these coupons were comprised of equiaxed grains having a size of about 10 μm and contained a discontinuous network of grain boundary carbides, they were undesirable because the continuous carbides present during the cold rolling operation were cracked and fissured and are inherited by the refined recrystallized microstructure. The presents of preformed cracks in the modified structure render the material unsuitable for high temperature service because of its lack of ductility and strength.

COMPARATIVE EXAMPLES F–N AND EXAMPLES 1–7

Coupons measuring 1.25 cm×5 cm×20 cm were taken from the wall of a cast austenitic tube having the same composition as that of the tube in the previous Comparative Examples. All the coupons were first heated for one hour at 1200° C. and subjected to hot working at various temperatures by passing them through a single stand mill at least twice. Each pass caused about 10% reduction of the coupon. After deformation, the coupons were tested for creep rupture. Table II below sets forth the experimental conditions for each coupon and Table III below sets forth the conditions and creep data for each coupon.

TABLE II

| Ex. | Rolling No. Passes | Total % Reduction | Anneal Temp °C. | Anneal Time hr. | Additional[1] Anneal | Grain Size (μm) |
|---|---|---|---|---|---|---|
| Comp. K | 2 | 19 | 1100 | 1 | yes | 200 |
| L | 2 | 19 | 1100 | 1 | yes | 200 |
| M | 6 | 58 | 1100 | 1 | yes | 190 |
| N | 6 | 58 | 1100 | 1 | yes | 190 |
| Ex. 1 | 2 | 19 | 1100 | 1 | no | 95 |
| 2 | 2 | 19 | 1100 | 1 | no | 95 |
| 3 | 2 | 19 | 1100 | 1 | no | 95 |
| 4 | 2 | 19 | 1100 | 1 | no | 95 |
| 5 | 2 | 19 | 1100 | 1 | no | 95 |
| 6 | 6 | 58 | 1100 | 1 | no | 68 |
| 7 | 6 | 58 | 1100 | 1 | no | 68 |

[1]one hour at 1300° C.

TABLE III

CREEP RUPTURE DATA

| Ex. | Temp. (°C.) | Stress (psi) | Rupture Time hr. | Pl. Strain on loading (%) | % Reduction Area | Meas. Elong. |
|---|---|---|---|---|---|---|
| F* | 1000 | 7870 | 2.1 | — | 31.2 | (1) |
| G* | 1000 | 5000 | 25.3 | 0.00 | 9.1 | 6.1 |
| H* | 1000 | 3000 | 177.2 | 0.00 | 0.2 | (1) |
| I* | 1050 | 5000 | 3.9 | 0.12 | 51.7 | 10.4 |
| J* | 1050 | 3000 | 54.3 | 0.00 | (1) | (2) |
| K | 1000 | 5000 | 3.3 | 0.26 | 45.7 | 32.0 |
| L | 1000 | 3000 | 23.4 | 0.00 | 51.1 | 12.8 |
| M | 1000 | 5000 | 1.5 | 0.47 | 50.0 | (1) |
| N | 1000 | 3000 | 5.0 | 0.00 | 33.4 | 40.0 |
| 1 | 1000 | 5000 | 52.4 | 0.00 | (3) | (3) |
| 2 | 1000 | 4000 | 163.9 | 0.00 | 6.5 | (1) |
| 3 | 1000 | 3000 | 716.6 | 0.00 | 2.2 | 1.6 |
| 4 | 1050 | 5000 | 9.9 | 0.00 | 37.2 | 9.6 |
| 5 | 1050 | 3000 | 203.3 | 0.00 | 8.9 | 6.5 |
| 6 | 1000 | 5000 | 23.4 | 0.00 | 27.5 | 10.9 |
| 7 | 1000 | 3000 | 505.0 | 0.00 | (2) | (2) |

(1) fragmented edges
(2) specimen destroyed
(3) equipment malfunction
*as received material The data of the above tables illustrates that at relatively large grain sizes the coupons are subject to creep rupture as opposed to the coupons having a grain size as claimed herein.

COMPARATIVE EXAMPLES O–Q

Three coupons having the same measurements and composition as those of the above examples were heated for one hour at 1200° C. then hot worked at 900° C. by passing twice through a single stand mill. The coupons were annealed for various times and temperatures. Table IV below sets forth the conditions under which the coupons were treated.

TABLE IV

| Ex. | Rolling No. Passes | Total % Reduction | Anneal Temp °C. | Anneal Time hr. | Grain Size (m) |
|---|---|---|---|---|---|
| Comp. O | 2 | 19 | 1100 | 1 | 59 |
| P | 2 | 19 | 1100 | 120 | 60 |
| Q | 2 | 19 | 1000 | 1 | 51 |

Hot rolling of the coupons represented in this Table IV resulted in massive cracking and fissuring. Therefore, hot working must be accomplished at temperatures greater than 900° C.

EXAMPLE 8

A cast austenitic steel having the composition as the coupons set forth below is heated for 1 hour at 1200° C. and subjected to deformation by extruding to cause a 30% reduction. The tube is annealed for 1 hour at 1100° C. and cooled to room temperature at a rate less than 100° C./hr. The tube will be found to have superior high temperature strength and ductility as well as improved creep properties.

What is claimed is:

1. A method for improving the high temperature properties of cast austenitic steel structures, the method comprising:

(a) heating the structures to at least the temperature at which chromium carbides go into solution, but below the temperature where incipient melting occurs;

(b) maintaining the structures at such temperature for an effective amount of time;

(c) hot working the structures by applying from about 15% to 60% plastic deformation; and (d) cooling the structures at a rate less than about 100° C./hr to allow recrystallization of the grains to occur such that the resulting average grain size is from about 45 μm to about 180 μm.

2. The method of claim 1 wherein the structures are heated to a temperature from about 1050° C. to about 1200° C.

3. The method of claim 2 wherein the structures are heated to a temperature of about 1100° C. to about 1200° C.

4. The method of claim 1 wherein the structures are maintained at such a temperature long enough to allow at least 75% of the chromium carbides to go into solution.

5. The method of claim 4 wherein the structures are maintained at such a temperature long enough to allow substantially all of the chromium to go into solution.

6. The method of claim 1 wherein at least 50% deformation is achieved.

7. The method of claim 5 wherein at least 50% deformation is achieved.

8. The method of claim 1 wherein the structures are tubes.

9. The method of claim 7 wherein the structures are tubes.

10. The method of claim 7 wherein the resulting average grain size is from about 80 μm to about 100 μm.

* * * * *